US006755373B1

(12) United States Patent
Moore

(10) Patent No.: US 6,755,373 B1
(45) Date of Patent: Jun. 29, 2004

(54) MICROWAVE RADIOMETRIC GUIDANCE SYSTEM

(75) Inventor: Robert P. Moore, China Lake, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 05/278,496

(22) Filed: Jul. 31, 1972

(51) Int. Cl.[7] ..... F41G 7/22
(52) U.S. Cl. ..... 244/3.17
(58) Field of Search ..... 244/3.14, 3.16, 244/3.17; 343/5 MM

(56) References Cited

U.S. PATENT DOCUMENTS 3,071,765 A * 1/1963 Schutz ..... 244/3.17 X
3,363,858 A * 1/1968 Dobbins et al. ..... 244/3.14
3,416,752 A * 12/1968 Hembree ..... 244/3.17

* cited by examiner

*Primary Examiner*—Charles T. Jordan
(74) *Attorney, Agent, or Firm*—David S. Kalmbaugh

(57) ABSTRACT

A missile guidance system utilizing a single microwave radiometric sensor for both terrain correlation and target homing. Terrain correlation is used to get the missile within the acquisition range of the homing system, and the homing system is used in the terminal phase of operation.

5 Claims, 8 Drawing Sheets

(U) FIG. 1. Types of Micrad Guidance.

(U) FIG. 2. Trajectory Types.

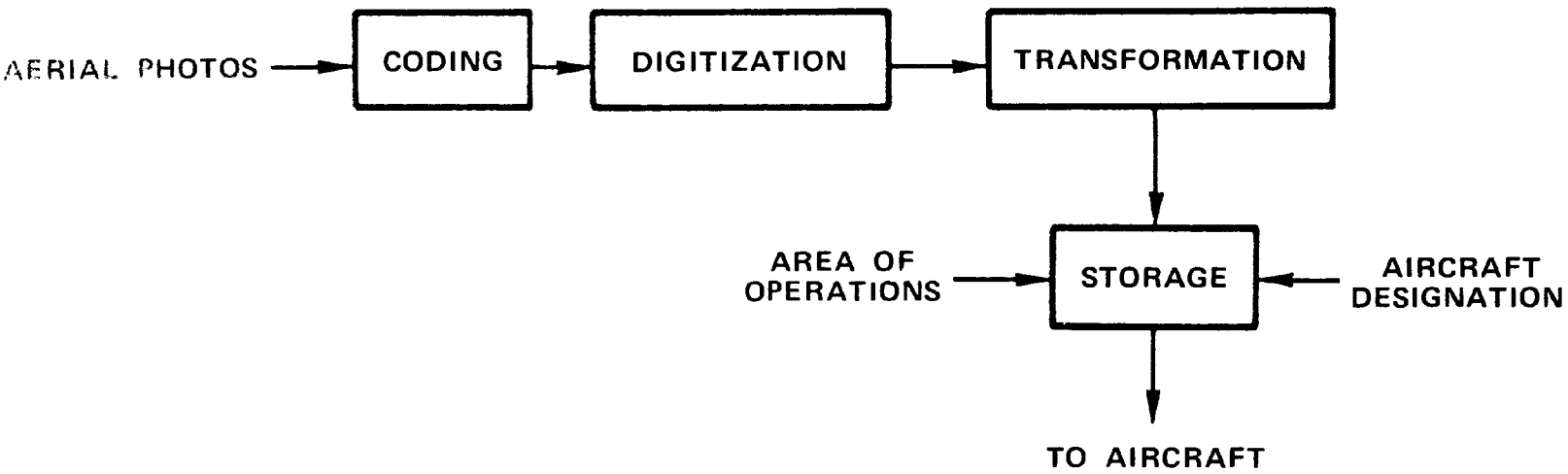
(U) FIG. 6. Data Conversion and Transfer.

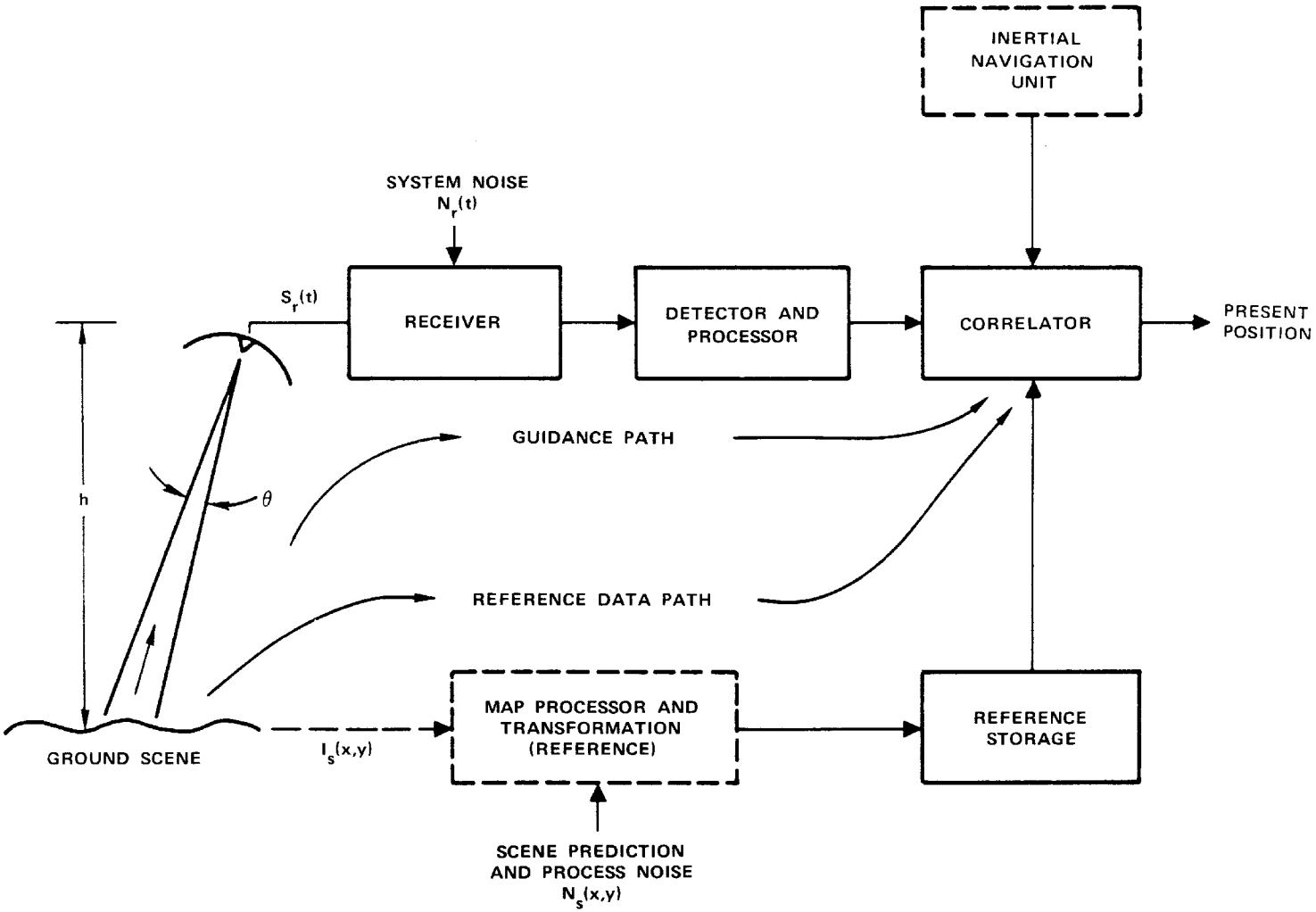
(U) FIG. 7. Correlation Process.

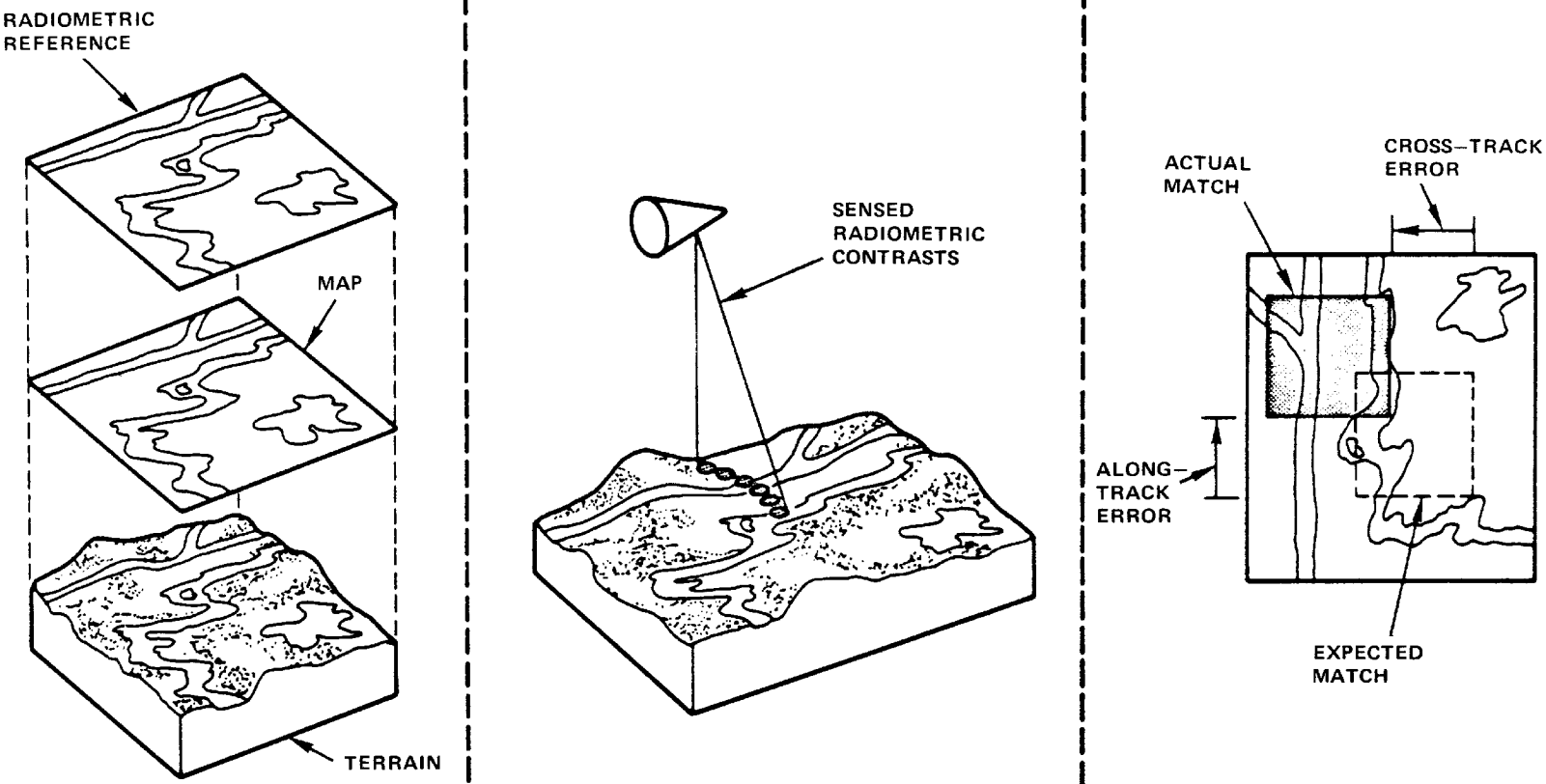
(a) Data preparation.
(b) Data acquisition.
(c) Data correlation.
(U) FIG. 8. MICRAD Fixing Concept.

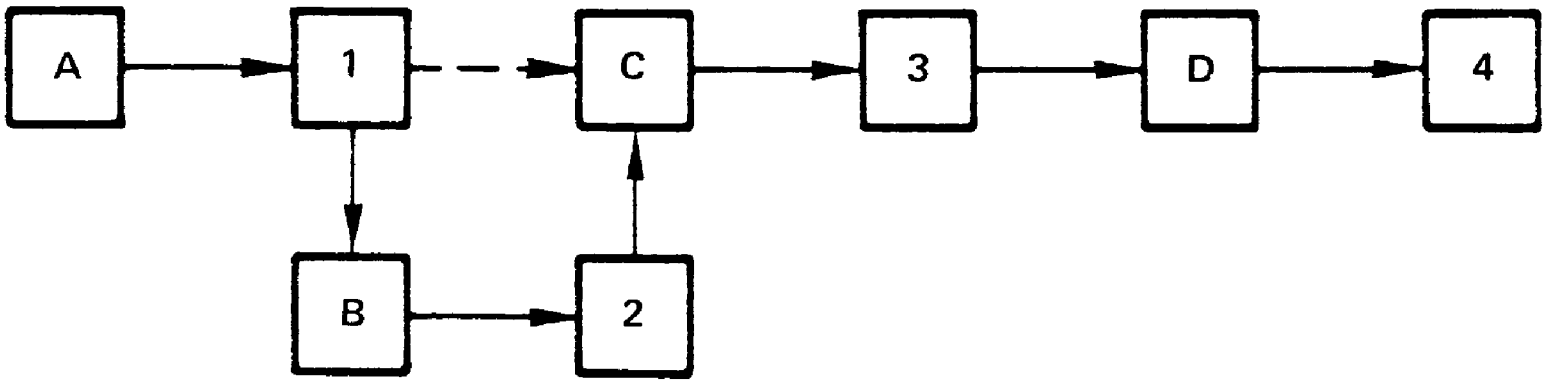
ERRORS
1. MID–COURSE ERROR
2. FIX ERROR
3. MANEUVER ERROR
4. IMPACT ERROR
MANEUVER DISTANCES
A. DATA COLLECTION
B. FIX MANEUVER
C. TERMINAL MANEUVER
D. TERMINAL CORRECTION
(U) FIG. 9. Error–Trajectory Flow Chart

MICROWAVE RADIOMETRIC GUIDANCE SYSTEM

BACKGROUND OF THE INVENTION

The present invention relates to the field of microwave radiometric (MICRAD) guidance systems. The three basic types of MICRAD guidance, shown in FIG. 1, are (1) fixing by terrain correlation, (2) target homing, utilizing tracking techniques similar to those used with radar, and (3) scene homing, utilizing target area correlation. Each guidance type has a number of advantages and disadvantages. Their pertinent characteristics are listed below. The performance figures are those that could be achieved under the most ideal conditions.

TABLE 1

| Type | Acquisition range | Minimum achievable error, ft | Countermeasure Type | Countermeasure Ease | Aim point selectivity | System complexity | Targeting complexity |
|---|---|---|---|---|---|---|---|
| Terrain correlation fixing | Very large | 25 | Continuous wave sidelobe jam | Very difficult | — | Moderate | Moderate |
| Target correlation homing | Large | <10 | Continuous wave sidelobe jam | Difficult | High | High | Moderate |
| Target homing | Small | <10 | Sidelobe jam<br>Decoy | Difficult<br>Easy | Low | Low | Low |

Examination of each of these three systems reveals that it would be difficult to fufill the standoff, air-to-surface missile requirements with any one system alone. The correlation fix system accuracy is limited by the quality of the reference. Routine accuracies less than 30 feet would require the highest quality references and reconnais-sance data and involve utilization of extensive complex data-processing techniques.

Correlation homing represents considerable complexity and suffers from stringent reference and reconnaissance requirements, complicated by the complex mapping geometry of the terminal phase (involving shallow-look angles and two-dimensional mapping).

Point homing has the disadvantages of limited range, and more importantly, restricted acquisition capability for targets located in complex backgrounds. If mid-course guidance results in sizable errors, there is a significant probability that the point homing system will lock onto a false target.

Although it would be difficult to meet the air-to-surface missile requirements with any one of the above techniques alone, it is possible to fulfill the requirements using both correlation fixing and point homing techniques in the same system, which system is herein described as the present invention. The correlation fix technique is utilized to get the missile within the reliable acquisition basket for point homing; and, since this may be 200 to 300 feet, the reference map requirements are greatly relaxed. If the missile can be aimed to within 200 feet of the target, the likelihood that the point homing system will lock onto a false target is very low. Therefore, the short-range limitation of the point homing system is immaterial. That is, since the course error after correlation fixing is only approximately 200 feet, the range requirement of the point homing system is small.

Various types of possible missile trajectories that can be used. Presently the pop-up trajectory is the most popular; however, each of the other kinds shown herein can be accommodated.

SUMMARY OF THE INVENTION

The present invention is a missile guidance system that utilizes a single microwave radiometric sensor for both terrain correlation and target homing. Terrain correlation is used to guide the missile to a point that is well within the acquisition and tracking range of the homing system. The homing system is then used to guide the missile to the target.

The advantages of the present invention over prior systems are that it is small, low-powered, inexpensive, passive, and capable of good target discrimination in the presence of foliage, camouflage, and sea clutter. It has superior operability that allows on-station targeting, weapon selection, 24-hour operation, and all-weather capability. And, it has target of opportunity potential and requires no access to the missile.

BRIEF DESCRIPTION OF THE DRAWINGS

FIG. 6 is a block diagram showing a data conversion and transfer process applicable to the present invention;

FIG. 7 is a block diagram, in partially schematic form, showing the correlation process performed by the missile;

FIG. 8 is a descriptive diagram of the fixing process performed by the missile; and FIG. 9 is a flow chart showing the trajectory error correction process of the present invention.

DESCRIPTION OF THE PREFERRED EMBODIMENT

Figure 1:
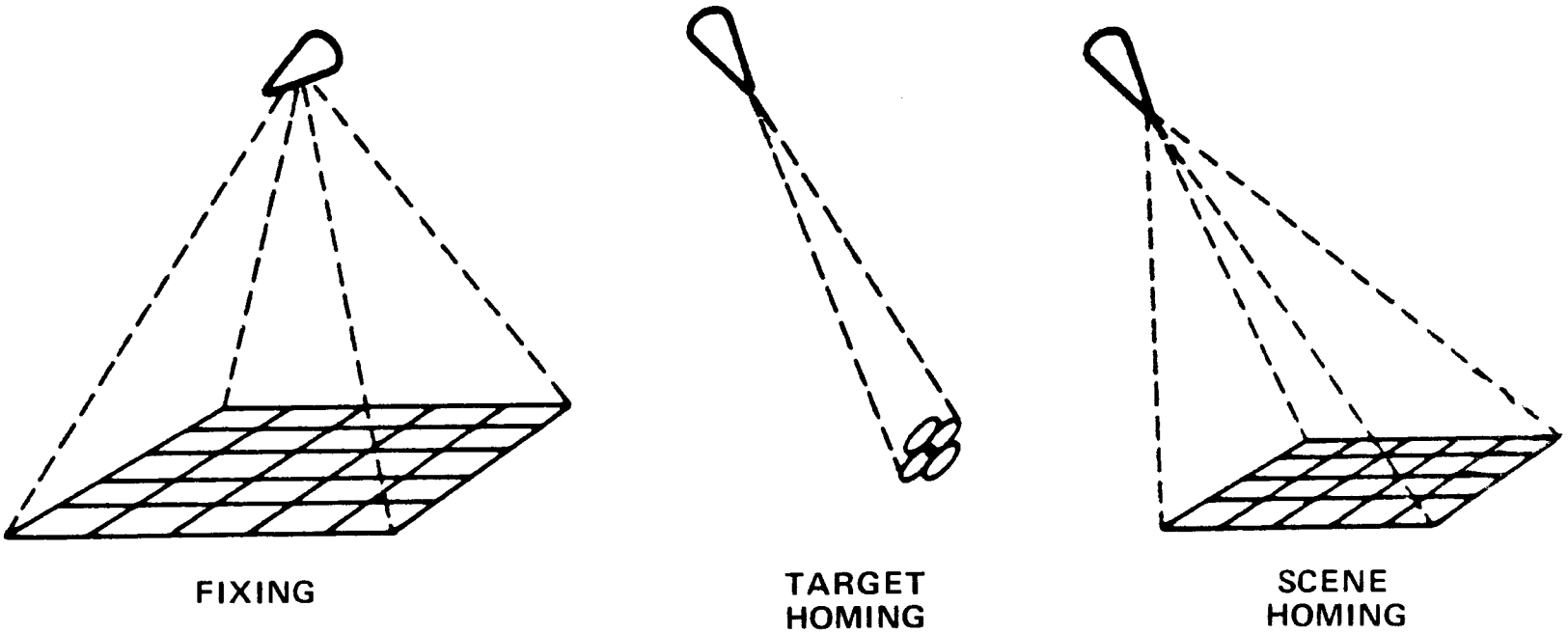
FIG. 1 is a descriptive diagram of the three basic types of MICRAD guidance.
Figure 2:
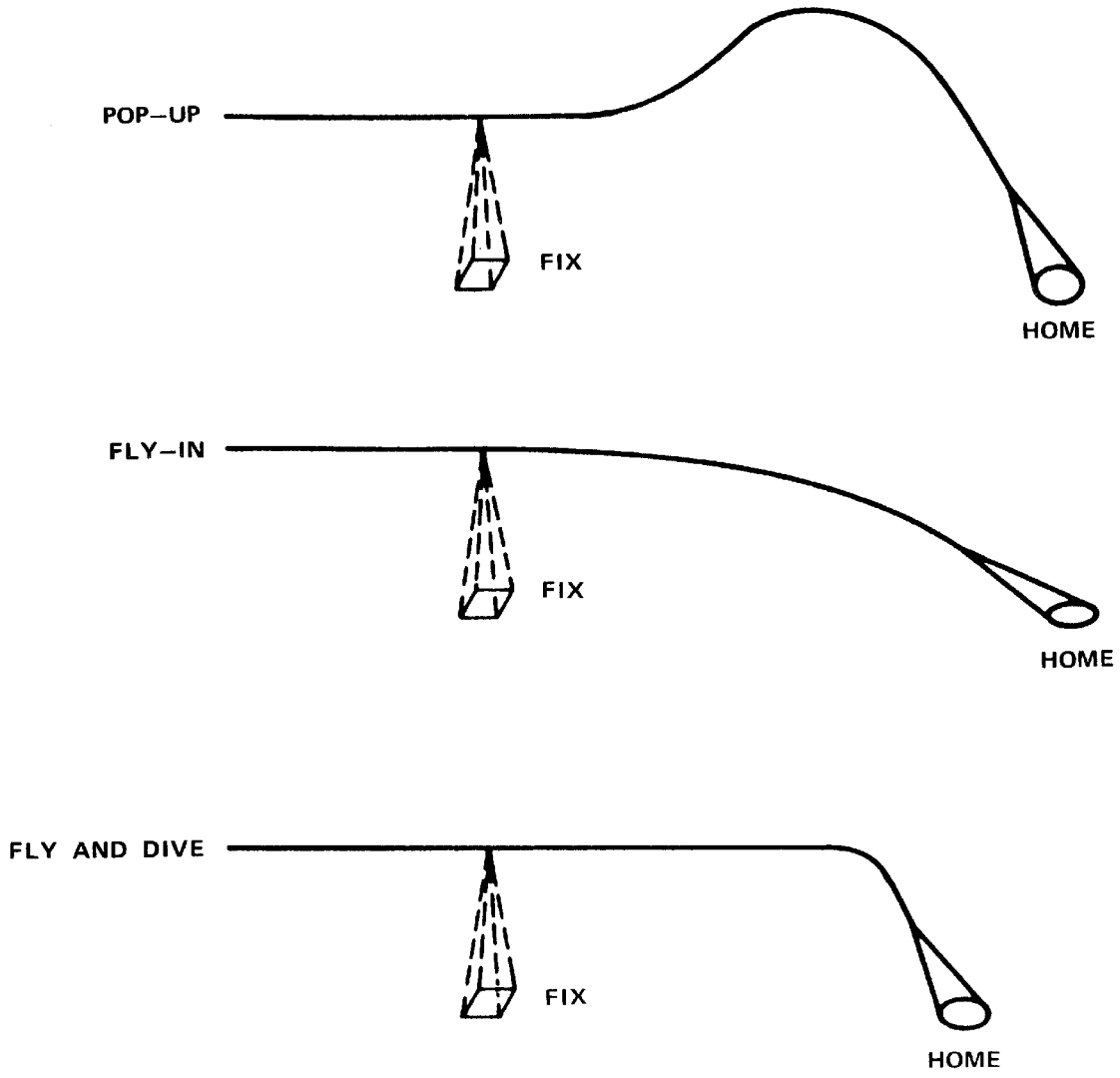
FIG. 2 is a descriptive diagram of three types of trajectories and shows correlation fixing and point homing techniques.
Figure 3:
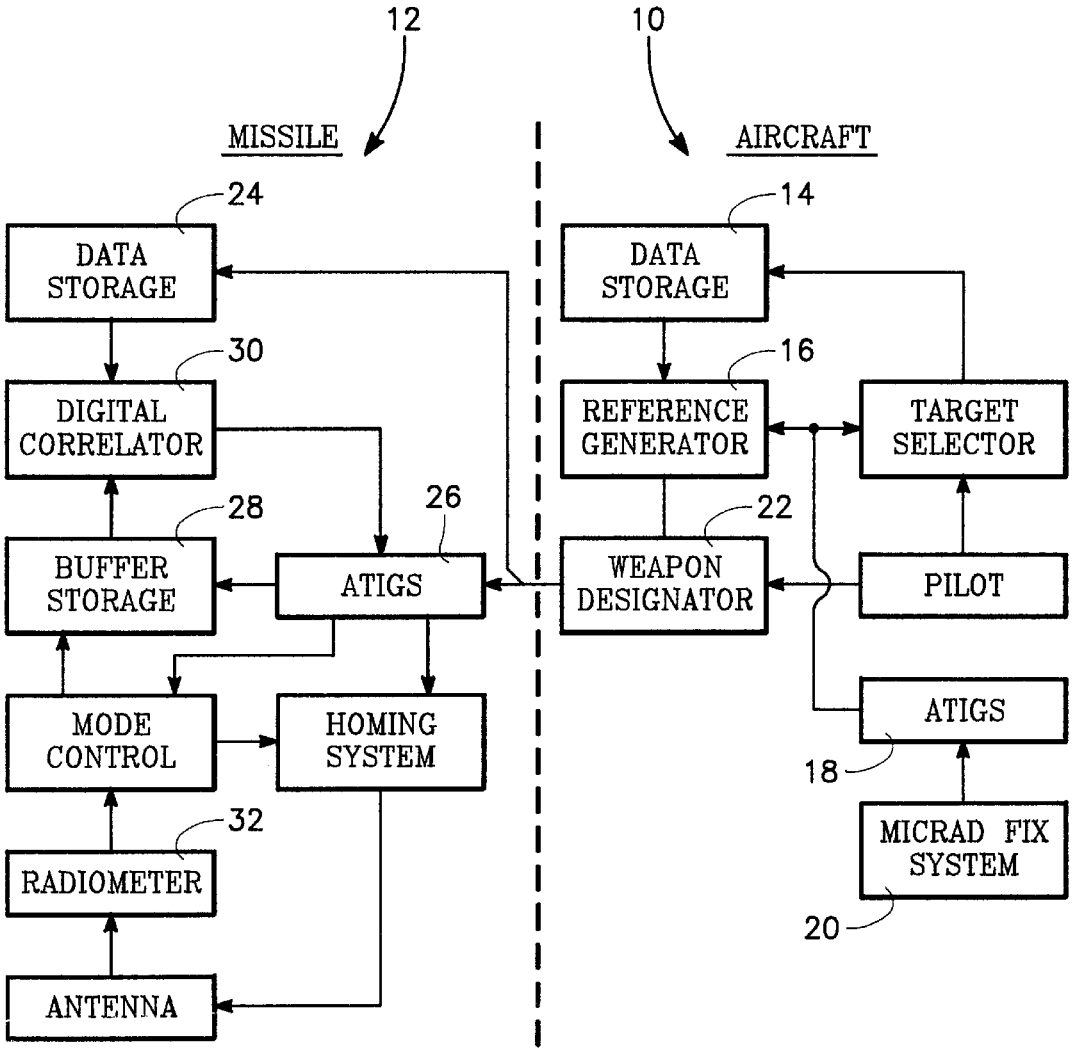
FIG. 3 is an operational block diagram of the MICRAD system of the present invention.

FIG. 1 shows the three basic types of microwave radiometric guidance systems, which are (1) fixing by train correlation, (2) target homing, utilizing tracking techniques similar to those used with radar, and (3) scene homing, by utilizing target area correlation. FIG. 2 graphically depicts the use of both correlation fixing and point homing techniques in the operation of an air-to-surface missile, wherein the correlation fixing techniques is utilized to get the missile within the reliable acquisition basket for point homing;

FIG. 3 is the MICRAD operational block diagram of the present invention. The system is divided into two parts, those located in the missile 12 on the left, and those located in the aircraft 10 on the right. In operation, the source data is converted on-board the carrier into the necessary reference. This can be done on a routine basis for target areas of high interest and updated and expanded with the normal flow of photo-reconnaissance data. This data may be either physically or electronically transferred to the attack aircraft on demand. If the aircraft is operating in a particular area, which is the usual case, all the necessary target data may be stored at once in the aircraft-and not changed until the area of operation is changed. When the pilot designates a target and a weapon, the appropriate reference material is moved from data storage 14 to reference generator 16 where it is corrected for the programmed missile trajectory, azimuth to the target, altitude, etc. The Inertial Guidance System (IGS) 18 determines the launch point and, therefore, the data selected. Shown in this block diagram is a MICRAD fix system 20 to provide high-accuracy launch-point information by means of inertial system updating, others may be used instead, if desired. Through weapon designator 22, the reference information is transferred to the correct missile data storage 24 and the launch position and guidance program to IGS system 26. When the fix area is reached, the system initiates the radiometer correlation mode. Radiometer 32 then collects a terrain map, which is transmitted to buffer storage 28. Attitude and scale corrections are made, and the data is then fed to digital correlator 30, which calls up the proper data from data storage system 24. The correlation is carried out, and a position fix is obtained, which is then applied to update the IGS system. IGS then maneuvers the missile to make the necessary course correction and perform the terminal maneuver, if any, at the termination of,which, IGS initiates the radiometer homing mode, and the missile is guided to the target.

Figure 4:
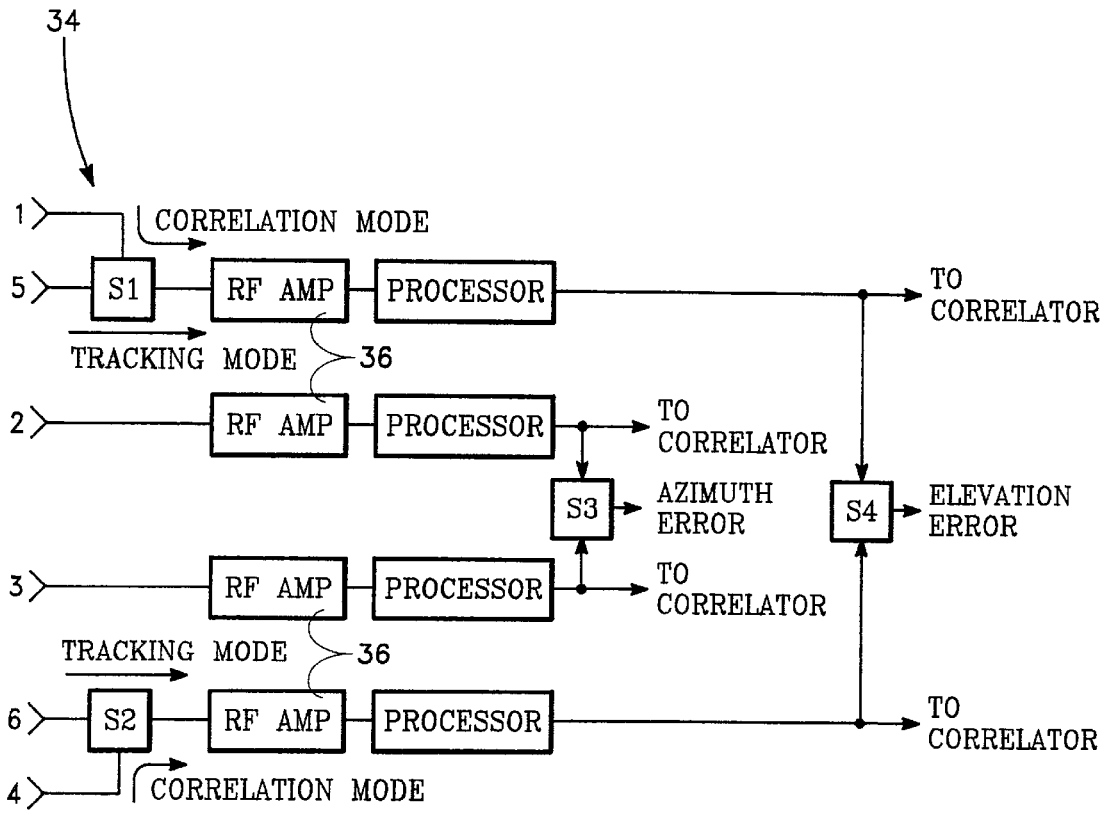
FIG. 4 illustrates one possible arrangement of utilizing one set of antennas and receivers for both correlation and homing.
Figure 5:
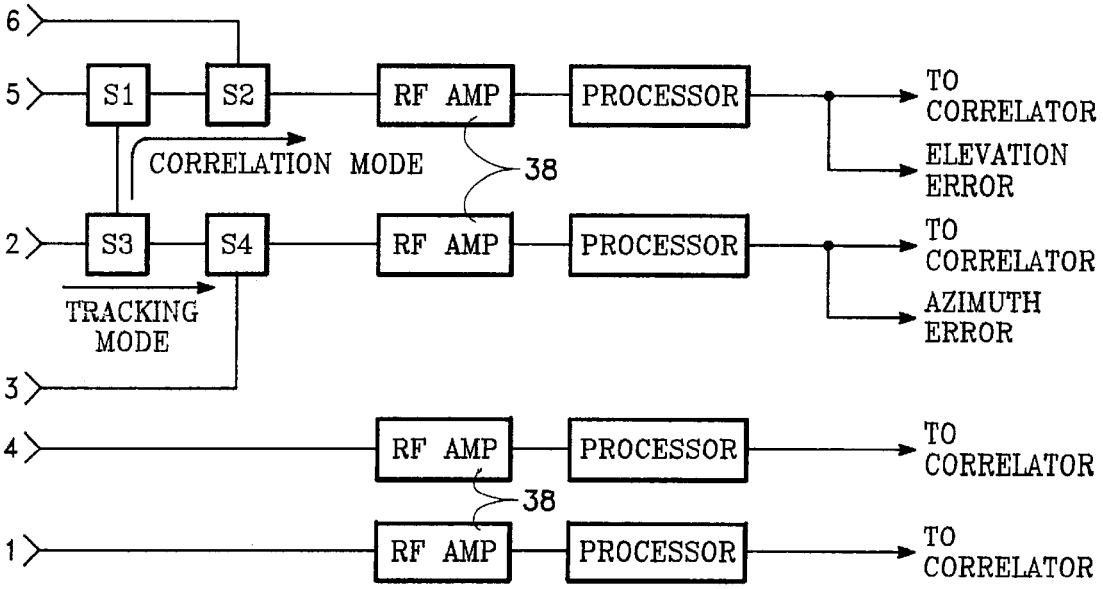
FIG. 5 illustrates another possible arrangement of utilizing one set of antennas and receivers for both correlation and homing.

The same antennas and receivers can be utilized for both correlation and homing. FIG. 4 illustrates one possible arrangement. The antenna utilized is a multiple-feed reflector 34. Feeds 1 through 4 are used in the correlation mode. In the homing mode, lobe switching is employed utilizing feeds 5 and 6 and 2 and 3. In this technique, four RF amplifiers 36 of the same type are used. During the homing mode, the switches S-1 and S-2 switch the receivers from feeds 1 and 4 to 5 and 6. Switches S-3 and S-4, under control of, such as, the reference oscillator 16, perform the lobe-switching function, producing a signal that, when phase-detected against the reference oscillator, produces azimuth and elevation error signals. An alternative switching arrangement might be utilized if, for example, parametric amplifiers were required to achieve the necessary homing acquisition range. This method (FIG. 5) allows two cheaper superheterodyne systems,to, be utilized, along with parametric amplifiers 38, for correlation, and the parametric amplifiers, alone, to be utilized for the homing mode. An antenna of the type described utilizing multiple dielectric feeds to form four beams has been developed by TRG Corporation.

Transformation of source material can be carried out on a semiautomatic basis utilizing a computer and the system shown in FIG. 6, which system is disclosed and claimed in co-pending U.S. application Ser. No. 276,340, filed Jul. 31, 1972. A photo interpreter first identifies features and materials in the photograph and codes them on the basis of density and color if available. These density/color codes are then entered into the computer. Under control of the computer, a flying spot scanner will scan the photograph, coding each point by means of the detected density and color. Thus, every point on the picture may be rapidly coded, digitized, and stored in the computer memory. The MICRAD sensor antenna filter function will be applied to this material map to convert it into radiometric form. The reference will be produced with detail sufficient for the lowest altitude to be flown. This reference, under control of the operations personnel, will be transferred to the designated aircraft. Operations will select data to cover the total area in which it is expected that the aircraft will operate. This will allow specific targets to be designated after the aircraft is in the air. Data transfer may be accomplished physically in the form of tape cassettes or be entered directly from the operations computer electronically through cables to the aircraft. Many variations are possible. The correlation process for the correlation mode is shown in FIGS. 7 and 8. To make a position fix, the radiometer samples the terrain radiometric temperature as shown in FIG. 7. One must bear in mind that what is obtained is a collection of numbers, and reorient himself from thinking in terms of patterns and pattern recognition. Most important, spatial resolution (the ability to separate closely spaced objects) is eliminated as a design goal. Antenna size, that is, beamwidth, is chosen on the basis of the S/N ratio that it can produce on the output of the correlator. However, the primary determining factor in the SIN ratio on the output of the correlator is the number of samples collected by the sensor. Contrary to popular belief, this is not affected by the antenna resolution; it is determined only by the terrain.

As shown in FIG. 8 a set of terrain temperatures for an area covering the expected error of the mid-course guidance is prepared from source data such as photographs. The temperatures are stored in the missile and when the missile approaches the fix point, a matrix of terrain temperatures is collected by the sensor, and then compared to the stored matrix values to determine where the missile was when the data was taken. This data is then utilized to update the inertial system.

The correlation can be likened to comparing codes. The sensor produces a code word that is compared to a set to find a matching word. The code words in this case are numbers associated with a position. The probability of identifying the correct matching set of numbers, and thus the position, depends on the uniqueness of the numbers. This uniqueness depends on the allowable values determined by S/N ratio, quantization, and the number of digits determined by map length. Errors in the numbers produced by sensor noise and reference noise (mistakes in prediction) reduce uniqueness.

Position errors much smaller than antenna resolution or sample spacing may be obtained. The correlation function varies in a predictable manner near the match point. Thus, interpolation can be used to obtain accuracies smaller than the distance between samples. Noise reduces the precision with which the interpolation can be made since the given points are in error. Ideally, if the cross-correlation function is plotted as a function of position, a peak will occur at the match point. However, the SIN ratio on the output of the correlator, due to poor sensor sensitivity or insufficient samples, may be too low to distinguish a match point. To overcome these deferencies a threshold can be set to eliminate false matches.

The accuracy, $\delta_x$, of the correlation system is given by:

$$\delta_x = D/M \tag{1}$$

where D is the correlation length and M is the S/N ratio on the output of the correlator.

FIG. 9 relates course errors to the various parts of the trajectory. The mid-course trajectory results in a mid-course error. A fix determines this error, which is a combination of guidance and launch errors. MICRAD data is collected over distance A. A fix maneuver, B, is carried out to put the missile back on course, but a fix error is still left. A terminal maneuver, C, such as a pop-up, is performed that results in a maneuver error (a combination of a fix error and whatever errors stem from the terminal maneuver, for example, gyro drift.) The homing system then acquires the target and guides the missile through a terminal correction, D, resulting in an impact error that originated from both the imperfect guidance system and from the missile dynamics.

What is claimed is:

1. A microwave radiometric guidance system for use in a missile, comprising:

electrically stored information;

a set of antennas;

a set of receivers coupled to said antennas for processing information signals received by the antennas;

a means for corrleating the information in the information signals received by said antennas and processed by said receivers with said stored information and guiding said missile in response thereto; and a means for guiding said missile to a preselected target in response to said received information signals.

2. The system of claim 1 wherein said correlating and guiding means and said target guiding means are sequential such that said correlating and guiding means activates first and guides said missile toward its objective, and said target guiding means activates subsequently and homes said missile on said target.

3. A microwave radiometric guidance system for use in a missile, comprising:

electrically stored information;

a set of antennas;

a set of receivers coupled to said antennas for processing information signals received by the antennas;

a means for correlating the information in the information signals received by said antennas and processed by said receivers with said stored information and guiding said missile in response thereto; and a means for guiding said missile to a preselected target in response to said received information signals;

wherein said correlating and guiding means and said target guiding means are separate, and are sequential such that said correlating and guiding means activates first and guides said missile toward its objective, and said target guiding means activates subsequently and homes said target; and wherein at least one antenna of said set of antennas is shared by said correlating and guiding means and target guiding means.

4. The system of claim 3 wherein said stored information is data describing a reference map of the earth's surface over which the missile is expected to pass.

5. The system of claim 4 wherein said set of antennas comprises six antennas and the first, second, third, and fourth antennas are used during the period said correlating and guiding means is activated, and are coupled thereto; the second, third, fifth, and sixth antennas are used during the period said target guiding means is activated, and are coupled thereto; the outputs of the fifth and sixth antennas provide data for obtaining the missile guidance elevation error; and, the outputs of the second and third antennas provide data for obtaining the missile guidance azimuth error.

* * * * *